United States Patent [19]

Lessi et al.

[11] Patent Number: 4,945,761

[45] Date of Patent: Aug. 7, 1990

[54] METHOD AND DEVICE FOR TRANSMITTING DATA BY CABLE AND MUD WAVES

[75] Inventors: Jacques Lessi, Maule; Pierre Morin, Levallois-Perret, both of France

[73] Assignee: Institut Francais du Petrole, Rueil Malmaison, France

[21] Appl. No.: 313,437

[22] Filed: Feb. 22, 1989

[30] Foreign Application Priority Data

Feb. 22, 1988 [FR] France ..... 88 02095

[51] Int. Cl.[5] ..... E21B 47/12

[52] U.S. Cl. ..... 73/151; 166/250; 175/40; 340/853; 367/81

[58] Field of Search ..... 73/151, 152; 166/250; 175/40, 45, 50; 324/323, 356, 369; 340/853, 854, 856, 857, 861; 367/81, 82, 83

[56] References Cited

U.S. PATENT DOCUMENTS

| | | | |
|---|---|---|---|
| 4,324,297 | 4/1982 | Denison | 73/151 |
| 4,788,545 | 11/1988 | Farque | 367/81 |
| 4,806,928 | 2/1989 | Veneruso | 340/857 |

OTHER PUBLICATIONS

McDonald et al., "Borehole Telemetry . . . Measurements", Oil and Gas Journal, Sep. 15, 1975, pp. 111–118.

*Primary Examiner*—John Chapman
*Assistant Examiner*—Kevin D. O'Shea
*Attorney, Agent, or Firm*—Antonelli, Terry, Stout & Kraus

[57] ABSTRACT

A device and method for transferring data between a bottom of a well and a surface, wherein a transfer of data is provided either by a mud wave generator or by a cable simultaneously or successively.

22 Claims, 4 Drawing Sheets

METHOD AND DEVICE FOR TRANSMITTING DATA BY CABLE AND MUD WAVES

BACKGROUND OF THE INVENTION

The present invention relates to a method and device for transmitting data generated by detection and/or measurement means placed in a well.

The present invention is particularly well adapted to measuring while drilling techniques generally designated by the initials MWD.

Well logging during drilling using an MWD type technique are destined for considerable development for two essential reasons; namely, a reduction of well logging costs, and a possibility of remote guiding of the drilling as a function of reservoir objectives which is of particular importance in the case of horizontal drilling. Apart from sensors or detectors for detecting purely drilling parameters, existing tools include a natural gamma radiation measurement probe, possibly oriented, a normal resistivity prove, etc.

There are several method for the transmission of measurements to the surface of the ground; namely, a transmission by cable, a transmission by mud waves, i.e., pressure pulses in drilling mud, and a transmission by electromagnetic waves.

In for example, French Patent No. 1,603,406, 1,603,706, and 1,602,653, several examples of devices for the transmission of data by mud waves are proposed and in, for example, an article entitled "Propagation of Electromagnetic Waves Among the Drilling of a Finite Conductivity" P. DeGauge and R. Gurdjinski, "SPE Drilling Engineering", June 1987, describes a transmission of electromagnetic waves.

While cable transmission has an advantage of being of a very good quality, and operates at high speeds such as, for example, hundreds of measurements per second, a disadvantage thereof resides in the fact that the cable transmission does not generally allow for a rotation of the drill string.

Moreover, while mud or electromagnetic wave transmission does not interfere with the drilling operations, a disadvantage of such transmission resides in the fact that their rate is much slower and amount to about one measurement about every ten seconds.

The achievement of a complete set of MWD well logs could come up against a transmission speed problem in the case of mud wave or electromagnetic wave transmission. This speed would in particular be insufficient in the case where real time processing of the measurements is to be carried out for monitoring the drilling.

The aim underlying the present invention essentially resides in providing a combined transmission which avoids the above mentioned drawbacks and disadvantages by providing combined transmission adapted to give continuously, via mud waves or electromagnetic waves, drilling parameters to which a few measurements related to the geological formation could be added. When the drilling conditions do not need the rotation of the drill string as a whole and when the measurements relative to the generator have an interest (e.g. for guiding drilling), a cable may be connected and enables a denser transmission of data measurements to the surface.

The transmission device of the present invention may also be constructed so that selection of the channels for measurements transmitted by mud waves or electromagnetic waves is normally, and if desired, effected by one of the conductors of the cable. By virtue of the device and method of the present invention make it possible to obtain, with a minimum time lag, pertinent data concerning the drilled geological formations, to reduce the cost of well logging because it is no longer necessary to immobilize the well for long periods of time corresponding to the well logging periods, to obtain a better quality of data since the measurement is achieved very rapidly after drilling, etc. Moreover, the data obtained under these conditions result in a precious saving in time for constructing elements which will be positioned in the well after drilling, such as perforated production casings in which the position of the perforations can be rapidly predicted. By pertinent data should be understood sophisticated data requiring a high transmission flow of the data when it is necessary, e.g. when passing through a critical zone of the geological formation and relatively poor data when the geological formation being drilled has no particular interest. In the case of directed drilling, 25 the poor data transmitted at low frequency may contain in particular the data for directing the drilling and the drilling parameters.

Thus, the present invention relates to a method for transmitting data generated by detection and/or measurement means placed in a well. According to this invention, the transmission is provided from one side by cable, or from another side by mud waves or electromagnetic waves, simultaneously or successively. The transmission may be carried out without withdrawing the detection and/or measurement means from the well. The transmission may be carried out intermittently by cable . The transmission may be carried out during drilling.

When the method of the present invention is applied to drilling by a downhole motor fixed to the end of a drill string, transmission may be made by cable when it is not necessary to rotate the drill string. In this case, transmission by mud waves or electromagnetic waves may be made at least during the drilling periods when cable transmission is not used, or permanently.

The cable may be used to achieve a real time transmission of the data i.e. as soon as the data are available.

The data to be transmitted by cable may equally be stored in a storage member forming part of the lower end 15 of the drill string and the cable may be lowered periodically so as to bring up the data stored in the lower part of the drill string.

The present invention also relates to a device for transmitting data generated by detection and/or measurement means placed in a well, with the device comprising transmission means including a cable and mud wave or electromagnetic wave transmission means, and means for remote connection of the cable with the detection and/or measurement means.

The cable transmission means may include means for storing the data and the detection and/or measurement means may be placed in a drill string substantially in the vicinity of the lower end of this drill string which may include a drilling tool driven by a downhole motor.

When the detection and/or measurement means comprise several channels capable of being transmitted by mud waves or electromagnetic waves, the device of the invention may comprise means for monitoring the channels effectively transmitted, with the monitoring means being adapted for receiving the reference relative to the channels to be transmitted from transmission means including the cable.

The device of the present invention may also comprise a side entry sub, and the cable may be an electric or an optic cable.

BRIEF DESCRIPTION OF THE DRAWINGS

The present invention will be better understood and its advantages will more clearly appear in the following description of particular examples, with reference to the accompanying drawings wherein.

DESCRIPTION OF THE PREFERRED EMBODIMENT

The following embodiments given by way of example, relate to the transmission of data by mud pulses, but it will also be possible to achieve transmission via electromagnetic waves without departing from the scope of the present invention.

Figure 1:
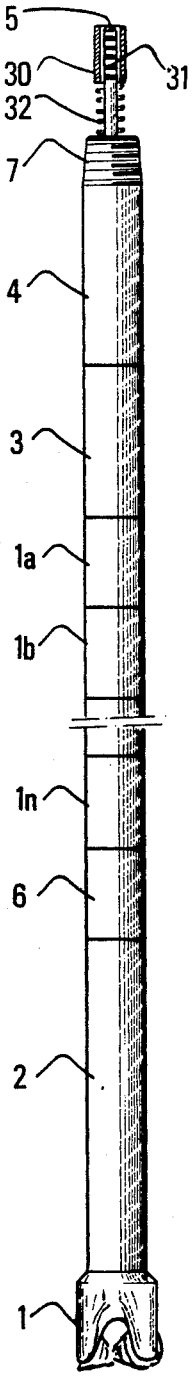
FIG. 1 is a schematical longitudinal view of an assembly formed of drilling tool a downhole motor and a battery of measurement probes and transmission members.

Referring now to the drawing wherein like reference numerals are used throughout the various views to designate like parts and, more particularly to FIG. 1, according to this figure, with downhole equipment of the present invention, drilling is carried out by using a downhole motor tool rotating a drilling tool 1, with a drill string including measurement probes or elements 1*a*, 1*b* . . . 1*n*. A multiplexer-selector 3 is connected to a mud wave generator 4, and to an electric connector 5. A means 6 for modifying may be a bent sub of the type disclosed in, for example, U.S. Pat. Nos. 4,286,676, 4,374,547 or French Patent No. 2,581,698. The sub may be placed just after the drilling tool 1 or, preferably, as illustrated in FIG. 1, just after the downhole motor 2. However, it is also possible to insert the sub on the measurement probes 1*a*, 1*b* . . . 1*n*.

Generally, the downhole motor tool is driven by a flow of drive fluid from the surface and, in this case, the measurement probes 1*a*, 1*b* . . . 1*n*, multiplexer-selector 3, and mud wave generator 4 will allow the flow of the drive fluid. In FIG. 1, the remaining elements or components of the drill string are connected to the mud wave generator 4 provided with a threaded portion 7 for this purpose.

Figure 2:
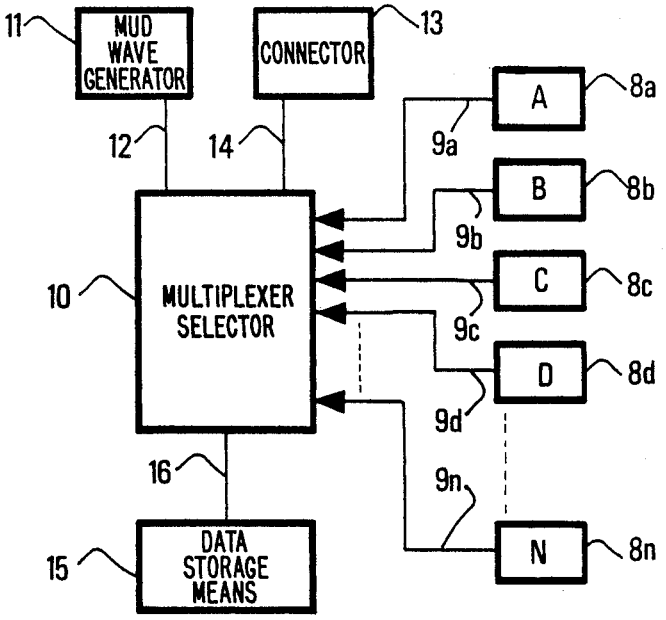
FIG. 2 is a schematic block diagram for depicting an operation of the of the present invention.

As shown in FIG. 2, parameter measurement probes 8*a*, 8*b*, 8*c*, 8*d* . . . 8*m* are provided for measuring parameters A, B, C, D . . . N, with lines 9*a*, 9*b*, 9*c*, 9*d* . . . 9*n* transmitting the measurement signals, generally electric, coming respectively from the measurement probes 8*a*, 8*b*, 8*c*, 8*d* . . . 8*m*, to a multiplexer-selector means 10 of the multiplexer-selector 3 for processing the signals received and transmitting some of this data to a mud wave generator means 11 of the mud wave generator 4 through one or more transmission lines. The multiplexer-selector means 10 also transmits signals to a connector 13 over an electric connection 14. A data storage means 15 for storing the data, possibly in digital form, are connected by one or more two-way data flow transmission lines 16 so as to make possible a filling of the memories of the data storage means 15 and a read out therefrom. The multiplexer-selector means 10 may comprise control means which can be driven or programmed for the connector 13, with the connector 13 serving for the transmission of data in both directions; namely, data going to the surface and control data coming down from the surface. Thus, the multiplexer means 10 may receive the selection measurement channels whose data can be transmitted by the mud wave generator means 11.

It is also within the scope of the present invention to provide one or more lines which may be connected directly to the mud wave generator means 11, to the connector 13, and to the data storage means 15 or to several of these elements simultaneously. While particularly, as shown in FIG. 2, all of the connections are made through the multiplexer-selector means 10.

As shown in FIGS. 3–8, a well 18 is drilled into the surface 17 of the ground by a drilling tool 19 driven by a downhole motor 20 mounted on an assembly 21, fixed to an end of a drill stream 22, comprising a bent sub, measurement probes, a multiplexer-selector, mud wave generator, and connector with the assembly 21 corresponding to the assembly in FIG. 1.

Figures 3, 4:
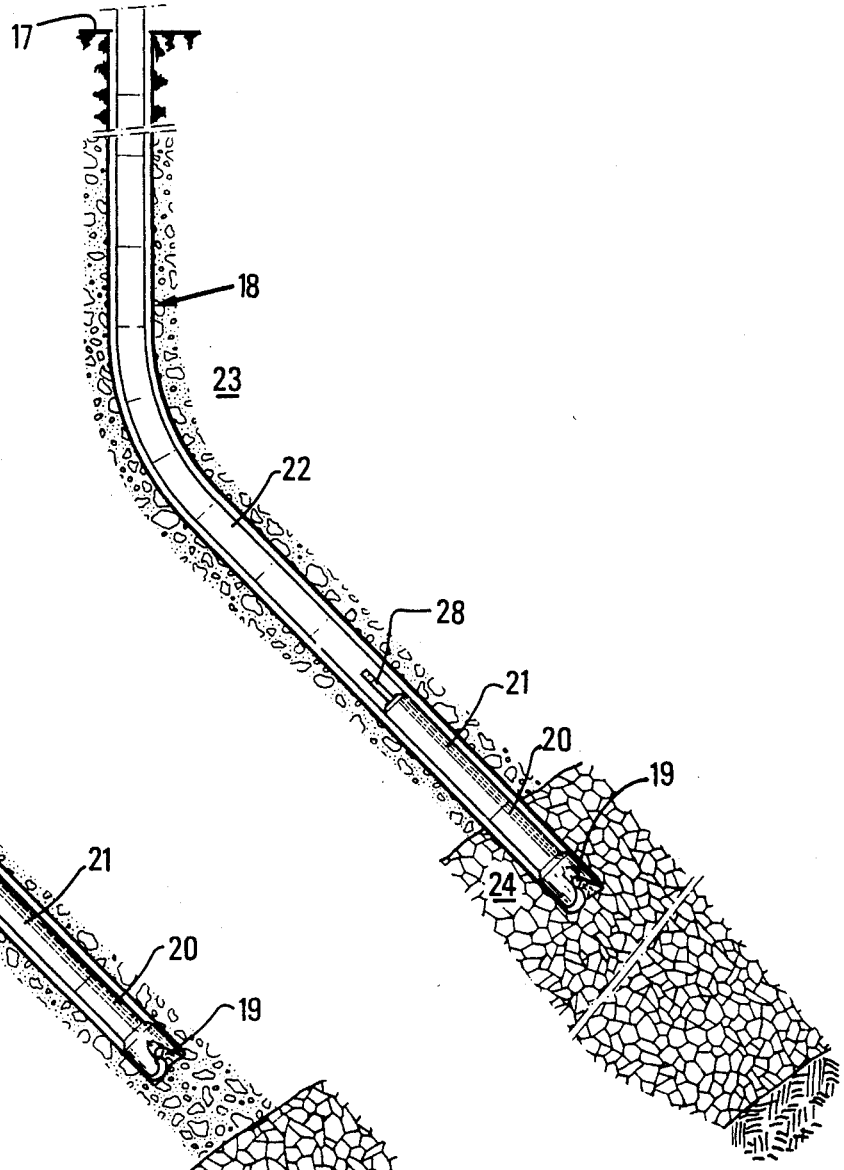
FIGS. 3–8 are schematic views respectively illustrating different steps of the method of the present invention with drilling equipment comprising a downhole motor.

In FIG. 3, a deviated well is drilled and drilling continues without particular difficulty through a geological formation 23 without any particular problem.

During this drilling phase, the mud wave generator transmits to the surface 17 the data from a limited number of probes. Thus, data may be transmitted concerning the drilling parameters, such as the torque, the weight, the pressure and the temperature, the direction of the drilling. The amount of data transmitted and their rate are limited by the performance of the systems using the mud waves, and the data thus transmitted by the mud waves makes it possible to monitor the drilling operation.

During this drilling phase, the drill string may be driven in rotation from the surface and thus if required drive the drilling tool 19 for drilling the well. Furthermore, the fact of being able to rotate the drill string avoids risks of jamming of the drill string.

The mud generator may advantageously transmit additional data concerning more particularly either the detection of an abnormal event, or the detection of a modification in the drilled geological formation.

FIG. 4 illustrates a phase of drilling corresponding to the penetration of the drilling tool into a new geological formation 24 and, at that moment, the mud wave generator transmits among the data which it conveys to the surface 17, data showing that the mud wave generator has detected the new geological formation 24. It is then up to the surface operator to decide whether to seek additional data or not and, if not, the drilling continues without modification. However, if additional data is desired, the drilling is interrupted and a connector 25 fixed to an end of the cable 26 (FIG. 5), is lowered from the surface 17. The lowering of the connector 25 may be achieved entirely by pumping as far as the connection, or else by gravity, and then by pumping.

Cable 26 may pass from the outside of the drill string to the inside thereof through a side entry sub 27 of a known type and, from the moment the connector 25 cooperates with the connector 28 of the assembly 21, the operator has a high data flow transmission connection available.

If the assembly 21 includes means for storing the data, the operator may ask for the stored data to be read out, at least if the drilling has been stored therein and if it interests the operator.

Figures 5, 6:
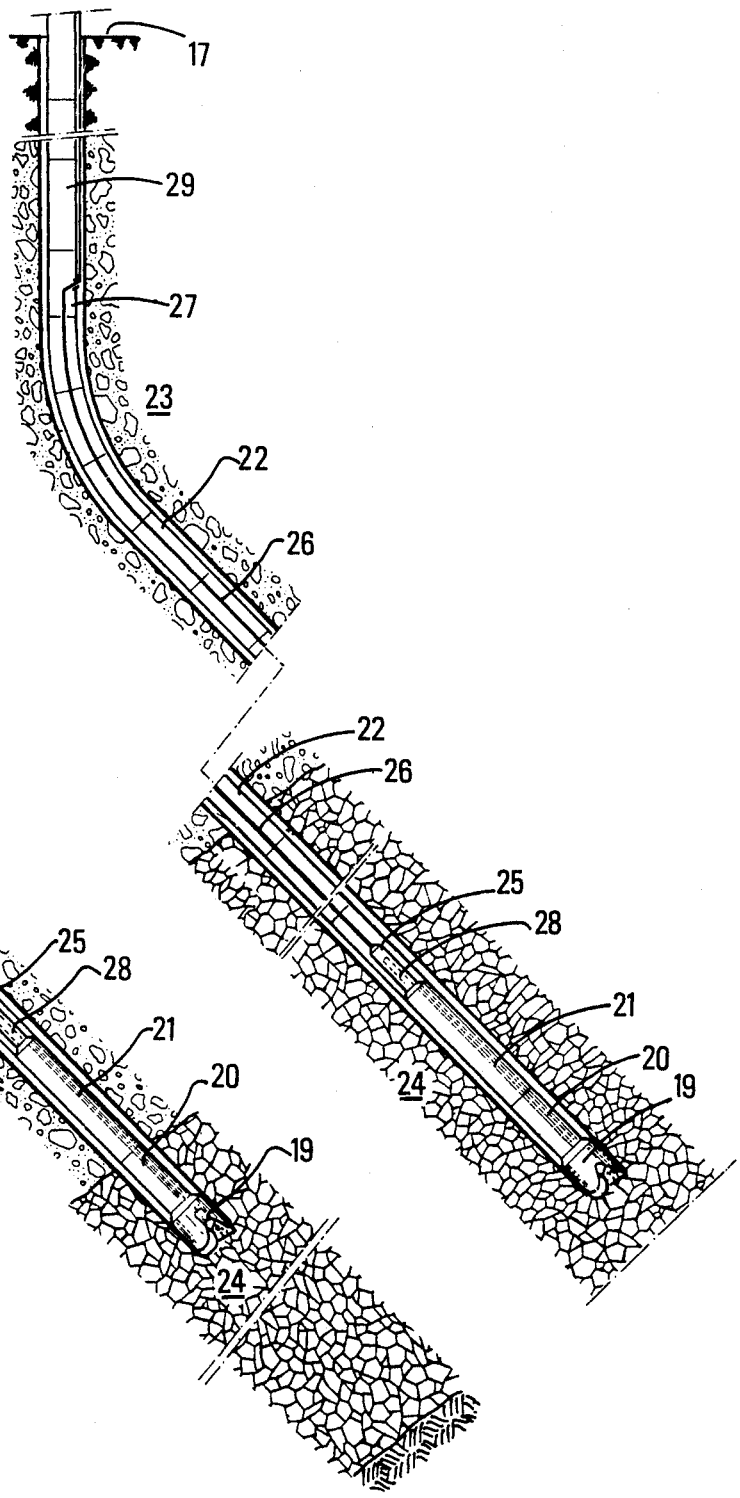

In the opposite case, the drilling continues by the downhole motor 20, by adding elements 29 to the drill string above the side entry sub 27. During this phase of the drilling, as shown in FIG. 6, the operator has available on the surface 17 sophisticated data requiring a high data transmission flow.

The parameters measured and transmitted may be those produced by acoustic probes, pulsed neutron probes, special resistivity measuring probes, etc.

The operator may decide to stop the mud wave generator during this drilling phase or not, for obviously the data transmitted by the mud wave generator may also be transmitted by the cable 26.

The data obtained through transmission of the signals by cable 26 provide good knowledge of the new geological formation 24 and show whether it is a hydrocarbon producing formation or not. Thus, the operator may decide on the path to be given to the drilling and may also know the characteristics to be given to the production casing which the operator will position at the level of this formation 24. Thus, the construction of such production casings may be undertaken with a sufficient construction time since the drilling is to continue further, whereas, in the prior art techniques, this time is very short, since it corresponds solely to the time for obtaining the delayed well logs.

From the moment when the operator thinks it unnecessary to transmit data with a high transmission flow, the cable 26 may be withdrawn. For that, the drill string is partially raised until the side entry sub 27 is at the level of surface 17 where it may be removed, as well as the cable 26.

Before withdrawing the cable 26, the operator may transmit through the same cable the control signal to the multiplexer-selector so as to choose the channels to be transmitted by the mud wave generator and possibly to cause operation of the latter. Additionally, as required, the operator may also program the means for storing the data.

Figure 8:
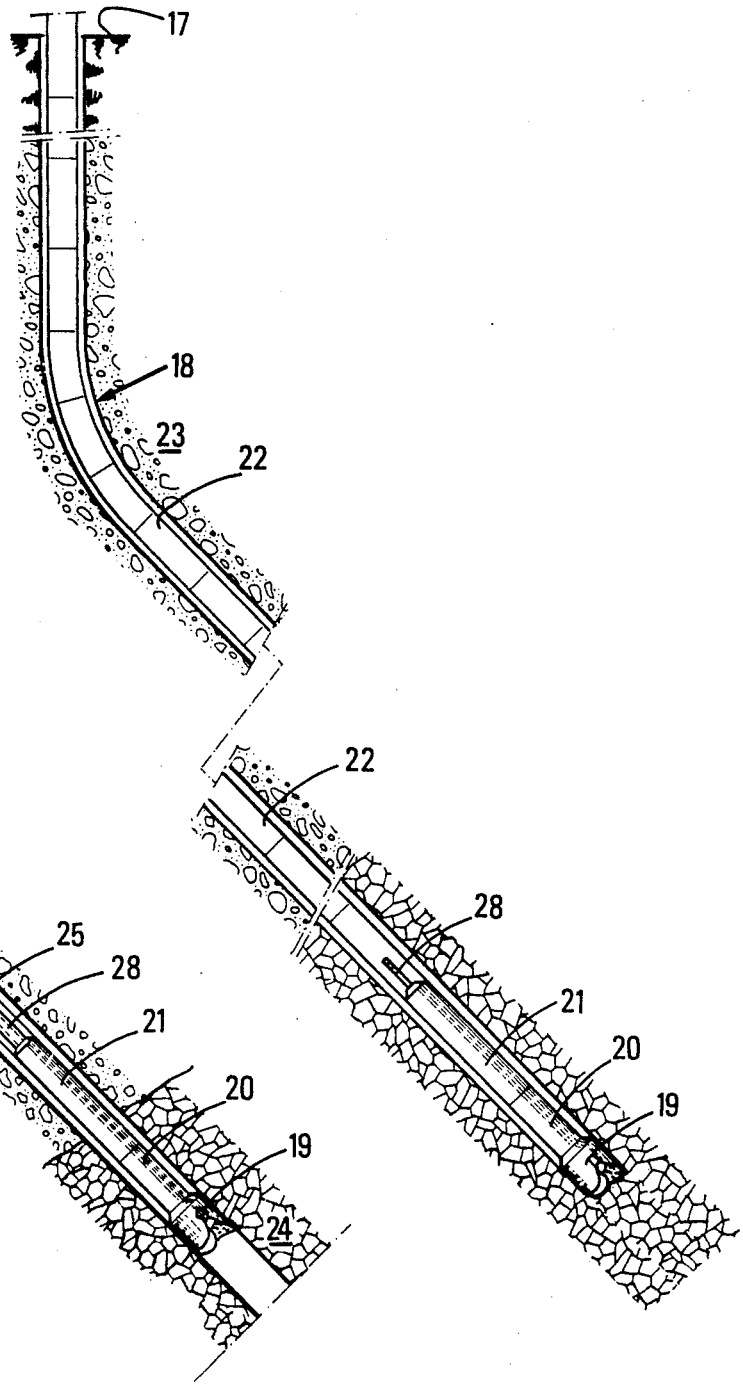
Figure 7:
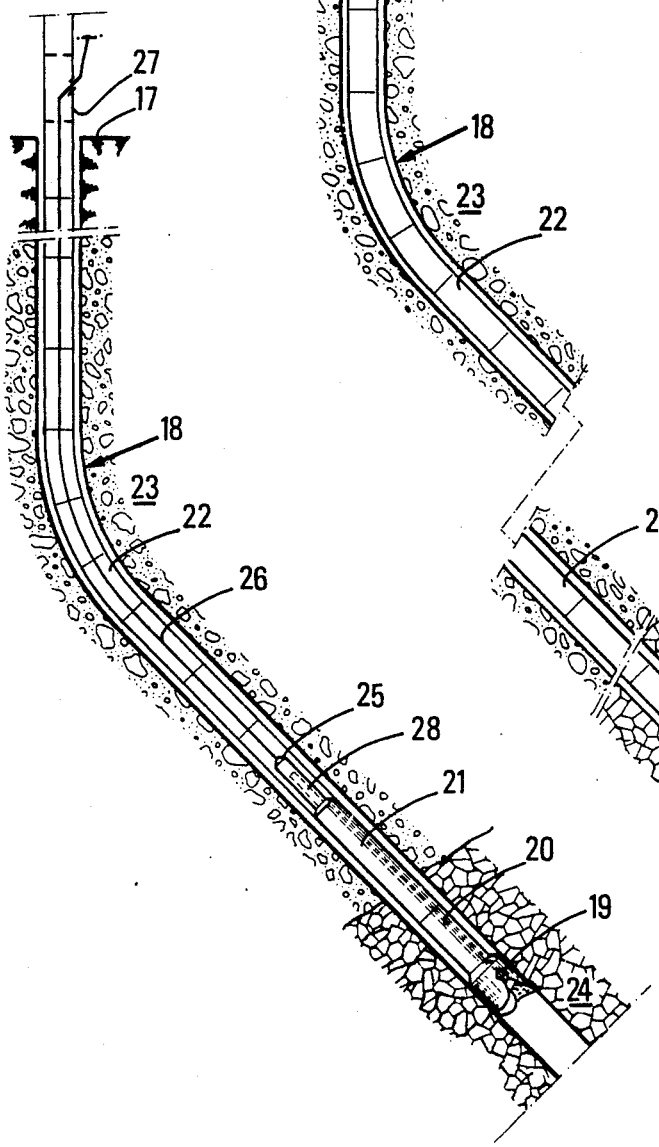

Once these operations have been carried out, the drilling may be resumed, as illustrated in FIG. 8, i.e. with the addition of elements of the drill string and in the absence of the cable.

The decision to withdraw cable 26 may also be motivated by the risks of jamming of the drill string which requires rotation of the drill string.

In FIG. 1, the male connector 5 is equipped with a sleeve 30 protecting the electric contacts 31. In the absence of a female connector, sleeve 30 is held at the level of the electric contacts 31 by a spring 32. Under the action of the female plug, sleeve 30 is retracted to the base of the male connector 5.

The present invention may also be applied in the case of drilling in the absence of a downhole motor and, in this case, the detection of a new geological formation will be transmitted to the operator by the mud wave generator. The operator may then continue the drilling over a sufficient length to carry out well logging and to lower the cable equipped with this connector for effecting the measurements by raising the drill string.

In the case where well logging is to be carried out over a considerable length, after drilling this length, it will be possible to raise the drill string by the same length, to lower the cable and connect it through a side entry sub to the connection on the assembly of the invention and to make the measurements either by adding additional drill string elements or by removing such elements.

Similarly as above, before withdrawing the cable, the operator may monitor the mud wave generator and possibly the the data storage means. In the case of the rotary drilling process where drilling takes place without a downhole motor, but with data storage means, they may be tripped automatically by the multiplexer-selector and drilling may continue over a sufficient length for making the desired measurements.

At the end of this drilling phase, the cable equipped with a connector may be lowered for cooperating with the assembly 21 and reading of the contents of the data storage means.

In that case, it is useless to use a side entry sub, at least if it is not desired to continue the transfer of data by means of the cable.

Here also, before withdrawing the cable, the operator will transmit his instructions to the multiplexer-selector.

What is claimed is:

1. A method of transmitting to a surface data generated by at least one of detection means and measurement means, the method comprising the steps of placing at least one of the measuring means and detecting means in a well, transmitting data from the at least one of the detection means and measuring means by cable means and one of mud waves and electromagnetic waves, wherein said transmitting of data occurs simultaneously or successively.

2. Method as claimed in claim 1, wherein said transmitting of data is carried out without withdrawing the at least one of the detection means and measurement means from said well.

3. Method as claimed in one of claims 1 or 2, wherein said transmitting of data is carried out intermittently by the cable means.

4. Method as claimed in one of claims 1 or 2, wherein said transmitting of data is carried out during a drill of the well.

5. Method as claimed in claim 4, wherein the drilling of the well is carried out by the downhole motor means fixed to an end of a drill string means, and wherein the transmitting of data is carried out by the cable means when it is not necessary to rotate said drilling string.

6. Method as claimed in claim 5, wherein the transmitting of data by one of mud waves and electromagnetic waves is used at least during drilling periods when transmitting of data by the cable means is not used.

7. Method as claimed in 5, wherein the transmitting of data by one of mud waves and electromagnetic waves is carried out permanently during drilling.

8. Method as claimed in claims 1 or 2, wherein the transmitting of data by the cable means is stored in a storage means situated in the well, and wherein said cable means may be lowered periodically into the well so as to bring up data stored in the data storage means.

9. A method as claimed in one claims 1 or 2, wherein the drilling of the well is carried out by a downhole motor means fixed to an end of a drill string means, and wherein the transmitting of data is carried out by the cable means when it is not necessary to rotate said drill string means.

10. A method as claimed in claim 9, wherein transmitting of data by one of the mud waves and electromagnetic waves is used at least during drilling periods when transmitting of data by the cable means is not used.

11. A method as claimed in one of claims 1 or 2, wherein the transmitting of data by one of mud waves and electromagnetic waves is carried out permanently during drilling.

12. A method as claimed in one of claims 1 or 2, wherein the step of placing the at least one of detection means and measurement means includes placing the same in a drill string means substantially in a vicinity of a lower end of the drill string means.

13. A method as claimed in one of claims 1 or 2, wherein the data transmitted by one of said mud waves and electromagnetic waves is transmitted in several monitorable channels.

14. A device for transmitting data relevant to a well drilling operation generated by at least one of detection means and measurement means for generating the data placed in a well, the device comprising transmission means including cable transmission means and at least one of mud wave transmission means and electromagnetic wave transmission means.

15. The device claimed in claim 14, further comprising means for remote connection of said cable means with said at least one of detection means and measurement means.

16. The device claimed in claim 15, wherein said transmission means includes means for storing the data.

17. The device claimed in one of claims 14, 15 or 16, wherein said at least one of detection means and measurement means are placed in a drill string means substantially in a vicinity of a lower end of said drill string means.

18. The device claimed in claim 17, wherein the lower end of the drill string means, comprises a drilling tool means.

19. The device claimed in claim 18, wherein each of the at least one of detection means and measurement means comprise several channels capable of being transmitted by one of mud waves and electromagnetic waves, further, comprising means for monitoring the channels effectively transmitted, said monitoring means being adapted for receiving a reference relative to the channels to be transmitted from transmission means including said cable means.

20. The device claimed in claim 19 comprising side entry sub means.

21. A device as claimed in claim 18, wherein said drilling tool means is driven by a downhole motor means.

22. A device according to one of claims 14, 15 or 16, wherein each of the at least one of detection means end measurement means comprises several channels capable of being transmitted by one of mud waves and electromagnetic waves, further, comprising means for monitoring the channels effectively transmitted, said monitoring means being adapted for receiving a reference relative to the channels to be transmitted from said transmission means including said cable means.

* * * * *